US012808204B2

(12) United States Patent
Lobbens

(10) Patent No.: US 12,808,204 B2
(45) Date of Patent: Nov. 24, 2026

(54) SET OF PANELS AND METHOD FOR INSTALLING THIS SET OF PANELS

(71) Applicant: UNILIN, BV, Wielsbeke (BE)

(72) Inventor: Antonio Lobbens, Wielsbeke (BE)

(73) Assignee: UNILIN, BV, Wielsbeke (BE)

( * ) Notice: Subject to any disclaimer, the term of this patent is extended or adjusted under 35 U.S.C. 154(b) by 192 days.

(21) Appl. No.: 18/656,735

(22) Filed: May 7, 2024

(65) Prior Publication Data

US 2024/0376722 A1 Nov. 14, 2024

Related U.S. Application Data

(60) Provisional application No. 63/603,137, filed on Nov. 28, 2023, provisional application No. 63/582,252, filed on Sep. 13, 2023, provisional application No. 63/501,416, filed on May 11, 2023.

(51) Int. Cl.
*E04F 15/02* (2006.01)

(52) U.S. Cl.
CPC ..... *E04F 15/02038* (2013.01); *E04F 2201/0138* (2013.01); *E04F 2201/0153* (2013.01); *E04F 2201/043* (2013.01)

(58) Field of Classification Search
CPC ..... E04F 15/02038; E04F 2201/0138; E04F 15/102; E04F 2201/043; E04F 13/18; E04F 2201/042; E04F 2201/0107; E04F 2201/0043; E04F 2201/0547; E04F 2201/0552; E04F 2201/023; E04F 2201/0535; E04F 2201/0146; E04F 2201/0153
See application file for complete search history.

(56) References Cited

U.S. PATENT DOCUMENTS

| | | | | |
|---|---|---|---|---|
| 6,729,091 | B1 * | 5/2004 | Martensson | E04F 15/04 52/391 |
| 7,721,503 | B2 * | 5/2010 | Pervan | E04F 15/02 52/177 |
| 7,877,956 | B2 * | 2/2011 | Martensson | E04F 15/04 52/582.1 |
| 8,069,631 | B2 * | 12/2011 | Pervan | E04F 15/02 52/592.1 |
| 8,234,834 | B2 * | 8/2012 | Martensson | E04F 15/02 52/582.1 |
| 10,837,182 | B2 * | 11/2020 | Lombaert | B32B 27/08 |
| 12,534,920 | B2 * | 1/2026 | De Rick | E04F 15/02016 |
| 2006/0196139 | A1 * | 9/2006 | Pervan | E04C 2/20 52/586.1 |
| 2021/0087832 | A1 * | 3/2021 | Boo | E04F 15/02038 |
| 2022/0243482 | A1 * | 8/2022 | Landgård | B32B 21/13 |

FOREIGN PATENT DOCUMENTS

| | | | |
|---|---|---|---|
| WO | 9747834 | A1 | 12/1997 |
| WO | 2009066153 | A2 | 5/2009 |
| WO | 2017068523 | A1 | 4/2017 |

(Continued)

*Primary Examiner* — Chi Q Nguyen
(74) *Attorney, Agent, or Firm* — Workman Nydegger

(57) ABSTRACT

A set of panels and a method for installing this set of panels, wherein the set includes a first type of panels being elongate and rectangular panels with long edges and short edges; and includes one or both of a second type of panels being square panels; a third type of panels being square panels.

20 Claims, 5 Drawing Sheets

(56) References Cited

FOREIGN PATENT DOCUMENTS

| | | | |
|---|---|---|---|
| WO | 2017115202 | A1 | 7/2017 |
| WO | 2017187298 | A2 | 11/2017 |
| WO | 2019138365 | A1 | 7/2019 |
| WO | 2021059062 | A1 | 4/2021 |
| WO | 2021070022 | A1 | 4/2021 |
| WO | 2021105798 | A1 | 6/2021 |
| WO | 2021111210 | A1 | 6/2021 |
| WO | 2022157618 | A1 | 7/2022 |

* cited by examiner

SET OF PANELS AND METHOD FOR INSTALLING THIS SET OF PANELS

BACKGROUND

The present invention relates to a set of panels, for example floor panels or wall panels, which is suitable for forming a covering, for example a floor covering or wall covering, and to a method for installing this set of panels. More particularly, it relates to a set of panels which are provided with well-defined coupling parts on their edges, which allow the panels to be coupled together.

The set comprises at least two types of panels, being elongate and rectangular panels and square panels, such that special installation patterns can be obtained.

It is first and foremost the objective of the present invention to provide an alternative set of panels which, at least in a specific embodiment thereof, is suitable to form a special installation pattern. In particular, it is an object of the invention to provide panels which can easily be laid, wherein these panels can be coupled together securely in such a way that the risk of differences in height, formation of gaps or cracks between the mutually coupled panels can be minimized.

SUMMARY

The invention relates, according to a first aspect, to a set of panels, for example floor panels or wall panels, comprising a first type of panels being elongate and rectangular panels comprising a pair of long edges and a pair of short edges; wherein both the long and the short edges are provided with mechanical coupling parts which allow the panels from the set to be coupled together; wherein a first long edge is provided with a male coupling part and a second long edge is provided with a female coupling part; wherein a first short edge is provided with a male coupling part and a second short edge is provided with a female coupling part;

and comprising one or both of a second type of panels being square panels comprising a first pair of opposite edges and a second pair of opposite edges; wherein said edges are provided with mechanical coupling parts which allow the panels from the set to be coupled together; wherein a first edge of the first pair of opposite edges is provided with a male coupling part and a second edge of the first pair of opposite edges is provided with a female coupling part; wherein a first edge of the second pair of opposite edges is provided with a male coupling part and a second edge of the second pair of opposite edges is provided with a female coupling part; wherein the dimensions of the first pair and the second pair of opposite edges match the dimensions of the short edges of said first type of panels;

a third type of panels being square panels comprising a first pair of opposite edges and a second pair of opposite edges; wherein said edges are provided with mechanical coupling parts which allow the panels from the set to be coupled together; wherein a first edge of the first pair of opposite edges is provided with a male coupling part and a second edge of the first pair of opposite edges is provided with a female coupling part; wherein a first edge of the second pair of opposite edges is provided with a male coupling part and a second edge of the second pair of opposite edges is provided with a female coupling part; wherein the dimensions of the first pair and the second pair of opposite edges match the dimensions of the long edges of said first type of panels.

The long edges of the first type of panels are opposite edges and the short edges of the first type of panels are opposite edges, such that the panels are elongate and rectangular panels.

Since this set of panels comprises elongate panels and square panels, special installation patterns can be obtained. The dimensions of said second and/or third type of panels match respectively the short and the long edges of the first type of panels, such that coupling between these panels is possible, and this without the formed covering comprising gaps. The coupling parts allow a good coupling between these panels. With matching of said dimensions is indicated that the dimensions are approximately the same or are the same.

In a preferred embodiment the set of panels comprise a fourth type of panels being elongate and rectangular panels comprising a pair of long edges and a pair of short edges; wherein both the long and the short edges are provided with mechanical coupling parts which allow the panels from the set to be coupled together; wherein a first long edge is provided with a male coupling part and a second long edge is provided with a female coupling part; wherein a first short edge is provided with a male coupling part and a second short edge is provided with a female coupling part; and wherein the first and the fourth type of panels have the same dimensions and wherein the coupling parts on the long edges of the first and the fourth type of panels are provided in mirror image. The first type of panels and the fourth type of panels form so-called A and B panels or mirror inverted panels or panels having coupling parts that are mirrored with respect to each other. With these fourth type of panels, more installation patterns are possible, for example installation patterns which have regions with a herringbone pattern and/or installation patterns wherein the first type of panels all extend according to one direction and the fourth type of panels all extend in another direction. The long edges of the fourth type of panels are opposite edges and the short edges of the fourth type of panels are opposite edges, such that the panels are elongate and rectangular panels.

Further preferably the panels of the first type of panels are provided to extend according to a first length direction and the panels of the fourth type of panels are provided to extend according to a second length direction, wherein the second length direction is perpendicular to the first length direction.

In a preferred embodiment a said male coupling part of one said panel can be fitted into, e.g. coupled to, each female coupling part of another said panel and wherein a said female coupling part of one said panel can also be coupled to each male coupling part of another said panel.

In a specific embodiment the mechanical coupling parts allow the panels from the set to be coupled together by means of a rotating movement and/or a horizontal shifting movement, preferably a horizontal shifting movement with snap-effect. Preferably, the coupling parts on all four edges are integrally formed from the material of the floor panel, preferably by means of a machine operation, for example a milling process or a process that comprises at least one milling operation. The expression "integrally formed from the material of the floor panel" is understood to mean that no essential separate parts, such as interlocking strips, inserts, or the like, still have to be provided on the already machine-processed edges during production. However, this does not rule out that this may be a floor panel whose substrate has an edge portion which consists of or comprises a material which differs from the material which is mainly used for the substrate of the floor panel, wherein the integrally formed coupling part is then entirely or partly formed in this edge portion. This may be the case, as is known, with the so-called "engineered wood" panels.

Further preferably the female coupling parts each comprise a lateral groove which is delimited by an upper lip and a bottom lip, the bottom lip of which extends distally beyond the upper lip and is provided with an upwardly pointing interlocking part; and the male coupling parts are provided with a tongue which, in the coupled position, can cooperate with the abovementioned lateral groove in order to bring about a vertical interlocking and with a downward directed interlocking groove which, in the coupled position, can cooperate with the abovementioned upwardly pointing interlocking part. These type of female and male coupling parts can be as described in WO 97/47834, WO 2021/070022, WO 2021/105798 or WO 2021/059062. The coupling parts described in these patent publications are incorporated by reference. When the coupling parts are of the type described in WO 2021/059062, then these panels are preferably of the type comprising recesses at the surface of the covering made with said panels, wherein these recesses are present between two panels mechanically coupled to each other by the male coupling part and the female coupling part,

- a said recess optionally comprises a first recess cut out or otherwise provided at the female edge; and optionally a second recess cut out or otherwise provided at the male edge;
- the recess comprises a grouting material. Between two connected panels, grouting material is provided and this to mimic a ceramic floor covering or wall covering. Of course if a grouting material needs to be provided between two connected panels, the dimensions of said panels are adapted to this such that the said dimensions of the second and/or the third type of panels and the dimensions of the respective short and/or the long edges of the first type of panels are approximately the same and allow making the desired pattern. Further the panels can comprise on their surface a groove, provided between and parallel or diagonally with two opposite edges that comprise coupling parts. The groove is provided for receiving grouting material after installation of a plurality of such panels in a covering, e.g. in a floor or wall covering. The width dimensions of this groove can be the same of the joint/seam formed between two coupled panels by said recesses.

In a specific embodiment, for at least the first and/or the fourth type of panels, the coupling parts of the long edges preferably show the following characteristics:

- the coupling parts comprise a horizontally active locking system, which, in a coupled condition of two of such floor panels, effects a locking in the plane of the floor panels and perpendicular to the respective edges;
- the coupling parts also comprise a vertically active locking system, which, in a coupled condition of two of such floor panels, effects a locking transverse to the plane of the floor panels;
- the coupling parts are configured such that two of such panels can be coupled to each other at these edges by means of a turning movement;

wherein the coupling parts of the short edges show the following characteristics:

- the coupling parts comprise a horizontally active locking system, which, in a coupled condition of two of such floor panels, effects a locking in the plane of the floor panels and perpendicular to the respective edges;
- the coupling parts also comprise a vertically active locking system, which, in a coupled condition of two of such floor panels, effects a locking transverse to the plane of the floor panels;
- the coupling parts substantially are realized from the material of the floor panel itself or the coupling parts comprise an additional insert;
- the coupling parts comprise at least an upward-directed lower hook-shaped part which is situated on one of said two short edges, as well as a downward-directed upper hook-shaped part, which is situated on the other of said two short edges, wherein the lower hook-shaped part consists of a lip with an upward-directed locking element, which proximally thereof defines a female part in the form of a recess, whereas the upper hook-shaped part consists of a lip with a downward-directed locking element forming a male part;
- the coupling parts are configured such that two of such floor panels can be coupled to each other at their respective edges by means of a downward movement of the one floor panel in respect to the other.

The panels can be installed by means of the so-called "fold down" method.

These type of female and male coupling parts can be as described in WO 2017/115202, WO 2021/111210, WO 2017/068523 or WO 2009/066153. The coupling parts described in these patent publications are incorporated by reference.

These panels preferably comprise coupling parts such that the panels are from the fold-down type. The second and/or the third type of panels can have coupling parts as described above.

In a preferred embodiment, for at least the first and the fourth type of panels, the male coupling part on the long edge can be fitted into the female coupling part on the long edge of another panel of the set by means of a rotating movement; wherein the male coupling part on the long edge can also be fitted into the female coupling part on the short edge of another panel from the set by means of a rotating movement; and wherein the male coupling part on the short edge can be fitted into the female coupling part on the long edge in one and the same rotating movement which is used to fit the male coupling part on the long edge into the female coupling part on the long or short edge. This allows to couple a panel of the first type of panels to a panel of the fourth type of panels in such a way that said panels extend according to perpendicular extending length directions. These type of female and male coupling parts can be as described in WO 2022/157618 or WO 2019/138365 or WO 2017/187298. The coupling parts described in these patent publications are incorporated by reference.

In a specific embodiment the mechanical coupling parts allow the panels from the set to be coupled together by means of a downward motion.

Preferably, the coupling parts on all four edges are integrally formed from the material of the floor panel, preferably by means of a machine operation, for example a milling process. The expression "integrally formed from the material of the floor panel" is understood to mean that no essential separate parts, such as interlocking strips or inserts or the like, still have to be provided on the already machine-processed edges during production. However, this does not rule out that this may be a floor panel whose substrate has an edge portion which consists of or comprises a material which differs from the material which is mainly used for the substrate of the floor panel, wherein the integrally formed coupling part is then entirely or partly formed in this edge portion. This may be the case, as is known, with the so-called "engineered wood" panels.

Preferably the coupling parts comprise interlocking parts which, in a mutually coupled position of panels, bring about an interlocking in a horizontal direction and an interlocking in a vertical direction.

In a very preferred embodiment, the set of panels comprise the first, the second, the third and the fourth type of panels.

The invention, according to a second aspect, relates to a set of panels, for example floor panels or wall panels, comprising a first type of panels being elongate and rectangular panels comprising a pair of long edges and a pair of short edges; wherein both the long and the short edges are provided with mechanical coupling parts which allow the panels from the set to be coupled together; wherein a first long edge is provided with a male coupling part and a second long edge is provided with a female coupling part; wherein a first short edge is provided with a male coupling part and a second short edge is provided with a female coupling part;

and comprising a second type of panels being square panels comprising a first pair of opposite edges and a second pair of opposite edges; wherein said edges are provided with mechanical coupling parts which allow the panels from the set to be coupled together; wherein a first edge of the first pair of opposite edges is provided with a male coupling part and a second edge of the first pair of opposite edges is provided with a female coupling part; wherein a first edge of the second pair of opposite edges is provided with a male coupling part and a second edge of the second pair of opposite edges is provided with a female coupling part; wherein the dimensions of the first pair and the second pair of opposite edges are approximately half the dimensions of the long edges of the first type of panels minus half of the dimensions of the short edges of said first type of panels;

a third type of panels being elongate and rectangular panels comprising a pair of long edges and a pair of short edges; wherein both the long and the short edges are provided with mechanical coupling parts which allow the panels from the set to be coupled together; wherein a first long edge is provided with a male coupling part and a second long edge is provided with a female coupling part; wherein a first short edge is provided with a male coupling part and a second short edge is provided with a female coupling part; and wherein the first and the third type of panels have the same dimensions and wherein the coupling parts on the long edges of the first and the third type of panels are provided in mirror image.

With half the dimensions is indicated 0.5 times the dimensions. For example if the first and third type of panels have a length of 120 cm and a width of 20 cm, thus have long edges with dimensions of 120 cm and have short edges with dimensions of 20 cm, the second type of panels are square panels with dimensions of approximate 50 cm by 50 cm.

The long edges of the first and third type of panels are opposite edges and the short edges of the first and the third type of panels are opposite edges, such that these panels are elongate and rectangular panels.

A set of panels according to the second aspect of the invention is ideally for forming a covering, for example a floor covering, having a basketweave pattern. For example the first type of panels and the third type of panels can have a wood decor, while the second type of panels can have a stone decor. Another possibility is that the first type of panels and the third type of panels have a wood decor in a first shade, while the second type of panels have a wood decor in a second shade, said second shade being lighter or darker than the first shade, such that a contrast is visible.

Preferably the panels of the first type of panels are provided to extend according to a first length direction and the panels of the third type of panels are provided to extend according to a second length direction, wherein the second length direction is perpendicular to the first length direction.

Preferably a said male coupling part of one said panel can be fitted into each female coupling part of another said panel and wherein a said female coupling part of one said panel can also be coupled to each male coupling part of another said panel.

In a specific embodiment the mechanical coupling parts allow the panels from the set to be coupled together by means of a rotating movement and/or a horizontal shifting movement, preferably a horizontal shifting movement with snap-effect. Preferably, the coupling parts on all four edges are integrally formed from the material of the floor panel, preferably by means of a machine operation, for example a milling process. The expression "integrally formed from the material of the floor panel" is understood to mean that no essential separate parts, such as interlocking strips, inserts, or the like, still have to be provided on the already machine-processed edges during production. However, this does not rule out that this may be a floor panel whose substrate has an edge portion which consists of or comprises a material which differs from the material which is mainly used for the substrate of the floor panel, wherein the integrally formed coupling part is then entirely or partly formed in this edge portion. This may be the case, as is known, with the so-called "engineered wood" panels.

Further preferably the female coupling parts each comprises a lateral groove which is delimited by an upper lip and a bottom lip, the bottom lip of which extends distally beyond the upper lip and is provided with an upwardly pointing interlocking part; and the male coupling parts are provided with a tongue which, in the coupled position, can cooperate with the abovementioned lateral groove in order to bring about a vertical interlocking and with a downward directed interlocking groove which, in the coupled position, can cooperate with the abovementioned upwardly pointing interlocking part. These type of female and male coupling parts can be as described in WO 97/47834, WO 2021/070022, WO 2021/105798 or WO 2021/059062. The coupling parts described in these patent publications are incorporated by reference. When the coupling parts are of the type described in WO 2021/059062, then these panels are preferably of the type comprising recesses at the surface of the covering made with said panels, wherein these recesses are present between two panels mechanically coupled to each other by the male coupling part and the female coupling part, a said recess optionally comprises a first recess cut out or otherwise provided at the female edge; and optionally a second recess cut out or otherwise provided at the male edge;

the recess comprises a grouting material. Between two connected panels, grouting material is provided and this to mimic a ceramic floor covering or wall covering. Of course if a grouting material needs to be provided between two connected panels, the dimensions of said panels are adapted to this such that the said dimensions of the second type of panels and the dimensions of the first and third type of panels allow coupling int the desired pattern, for example a basketweave pattern. Further the panels can comprise on their surface a groove, provided between and parallel or diagonally with two opposite edges that comprise coupling parts. The groove is provided for receiving grouting material after installation of a plurality of such panels in a covering, e.g. in a floor covering. The width dimensions of this groove can be the same of the joint/seam formed between two coupled panels by said recesses.

In a specific embodiment the mechanical coupling parts allow the panels from the set to be coupled together by means of a downward motion.

In a specific embodiment, for at least the first and/or the third type of panels, the coupling parts of the long edges preferably show the following characteristics:

- the coupling parts comprise a horizontally active locking system, which, in a coupled condition of two of such floor panels, effects a locking in the plane of the floor panels and perpendicular to the respective edges;
- the coupling parts also comprise a vertically active locking system, which, in a coupled condition of two of such floor panels, effects a locking transverse to the plane of the floor panels;
- the coupling parts are configured such that two of such panels can be coupled to each other at these edges by means of a turning movement;
- wherein the coupling parts of the short edges show the following characteristics:
- the coupling parts comprise a horizontally active locking system, which, in a coupled condition of two of such floor panels, effects a locking in the plane of the floor panels and perpendicular to the respective edges;
- the coupling parts also comprise a vertically active locking system, which, in a coupled condition of two of such floor panels, effects a locking transverse to the plane of the floor panels;
- the coupling parts substantially are realized from the material of the floor panel itself or the coupling parts comprise an additional insert;
- the coupling parts comprise at least an upward-directed lower hook-shaped part which is situated on one of said two short edges, as well as a downward-directed upper hook-shaped part, which is situated on the other of said two short edges, wherein the lower hook-shaped part consists of a lip with an upward-directed locking element, which proximally thereof defines a female part in the form of a recess, whereas the upper hook-shaped part consists of a lip with a downward-directed locking element forming a male part;
- the coupling parts are configured such that two of such floor panels can be coupled to each other at their respective edges by means of a downward movement of the one floor panel in respect to the other.

The panels can be installed by means of the so-called "fold down" method.

These type of female and male coupling parts can be as described in WO 2017/115202, WO 2021/111210, WO 2017/068523 or WO 2009/066153. The coupling parts described in these patent publications are incorporated by reference.

These panels preferably comprise coupling parts such that the panels are from the fold-down type. The second type of panels can have coupling parts as described above.

In an embodiment, for at least the first and the third type of panels, the male coupling part on the long edge can be fitted into the female coupling part on the long edge of another panel of the set by means of a rotating movement; wherein the male coupling part on the long edge can also be fitted into the female coupling part on the short edge of another panel from the set by means of a rotating movement; and wherein the male coupling part on the short edge can be fitted into the female coupling part on the long edge in one and the same rotating movement which is used to fit the male coupling part on the long edge into the female coupling part on the long or short edge.

Preferably, the coupling parts comprise interlocking parts which, in a mutually coupled position of panels, bring about an interlocking in a horizontal direction and an interlocking in a vertical direction.

The invention also relates to a method for installing a set of panels, wherein a set as described above in the first aspect or in the second aspect is used, and wherein a pattern is produced.

In preferred embodiments of the invention the panels are decorative panels and comprise at least a substrate and a decorative top layer. These decorative panels can be of different types. The decor of the decorative top layer may be any kind, such as wood or stone decor. It is possible that the different types of panels have different decors, e.g. the elongate and rectangular patterns can have a wood décor and the square panels can have stone decors or vice versa. A substrate of the panel can comprise wood. The substrate can, for example, comprise several wooden slats connected to each other. This is typically the case with engineered wood. However, the substrate can also be formed as a single part made of wood, for example, solid wood. The substrate of the panel can comprise wood particles and a binder for mutually binding the wood particles. Such a substrate is a wood-based substrate. The wood particles can be wood fibers and/or wood chips. The binder can be a glue or resin, The substrate comprises, for example, a wood fiberboard, such as Medium Density Fiberboard (MDF) or High-Density Fiberboard (HDF), or a chipboard. One or more resin impregnated papers could be laminated upon such a wood-based substrate and form the top layer. Other layers are also possible. The substrate of the panel can comprise a thermoplastic material. The thermoplastic of the thermoplastic material can be polyvinyl chloride (PVC), polyethylene (PE), polypropylene (PP), polyurethane (PU), or polyethylene terephthalate (PET). The thermoplastic material can comprise polyvinyl chloride, or another thermoplastic material, and whether or not plasticizers. The thermoplastic material can or cannot be foamed. The thermoplastic material can comprise closed-cell or open-cell foam. The thermoplastic material can comprise a filler. The filler can be an organic filler, such as wood particles. The filler can be an inorganic filler such as calcium carbonate, chalk or limestone. The filler can be talc. The substrate of the panel can comprise any desired other material, such as a cement fiber panel or a magnesium panel.

In summary, the set of panels of the invention are not limited to specific types of materials of panels, but may be applied in all kinds of panels.

BRIEF DESCRIPTION OF THE DRAWINGS

In order to show the features of the invention in more detail, some preferred embodiments are described below by way of example and without being limited thereto, with reference to the accompanying drawings, in which.

DETAILED DESCRIPTION OF THE INVENTION

Figure 1:
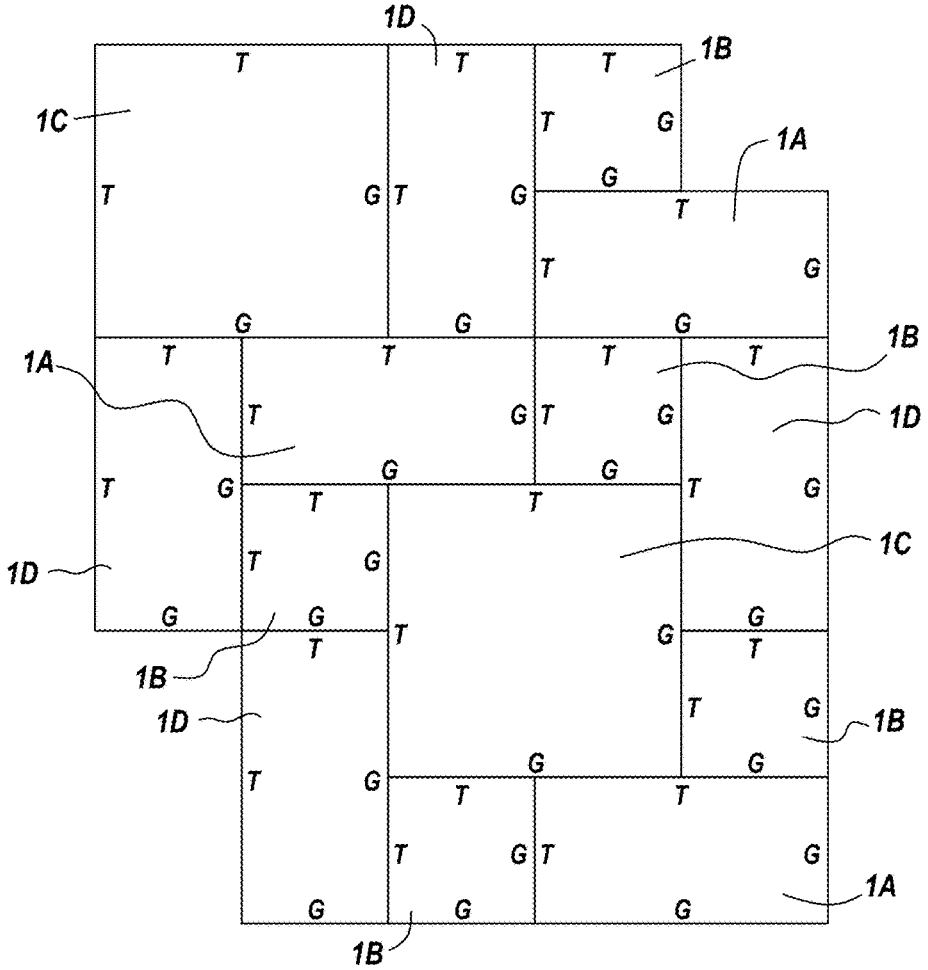
FIG. 1 shows a top view of a covering comprising a first embodiment of a set of panels according to the first aspect of the invention, comprising a first, a second, a third and a fourth type of panels, wherein the covering has a certain pattern.

The invention according to the first aspect relates to a set of floor panels comprising at least a first type of panels being elongate and rectangular panels 1A comprising a pair of long edges 2-3 and a pair of short edges 4-5; wherein both the long and the short edges are provided with mechanical coupling parts 6-7-8-9 which allow the panels from the set to be coupled together; wherein a first long edge 2 is provided with a male coupling part 6 and a second long edge 3 is provided with a female coupling part 7; wherein a first short edge 4 is provided with a male coupling part 8 and a second short edge 5 is provided with a female coupling part 9; and comprising one or both of a second type of panels being square panels 1B comprising a first pair of opposite edges 2-3 and a second pair of opposite edges 4-5; wherein said edges are provided with mechanical coupling parts 6-7-8-9 which allow the panels from the set to be coupled together; wherein a first edge 2 of the first pair of opposite edges is provided with a male coupling part 6 and a second edge 3 of the first pair of opposite edges is provided with a female coupling part 7; wherein a first edge 4 of the second pair of opposite edges is provided with a male coupling part 8 and a second edge 5 of the second pair of opposite edges is provided with a female coupling part 9; wherein the dimensions of the first pair and the second pair of opposite edges match the dimensions of the short edges 4-5 of said first type of panels 1A;

a third type of panels being square panels 1C comprising a first pair of opposite edges 2-3 and a second pair of opposite edges 4-5; wherein said edges are provided with mechanical coupling parts 6-7-8-9 which allow the panels from the set to be coupled together; wherein a first edge 2 of the first pair of opposite edges is provided with a male coupling part 6 and a second edge 3 of the first pair of opposite edges is provided with a female coupling part 7; wherein a first edge 4 of the second pair of opposite edges is provided with a male coupling part 8 and a second edge 5 of the second pair of opposite edges is provided with a female coupling part 9; wherein the dimensions of the first pair and the second pair of opposite edges match the dimensions of the long edges 2-3 of said first type of panels 1A.

and optionally a fourth type of panels being elongate and rectangular panels 1D comprising a pair of long edges 2-3 and a pair of short edges 4-5; wherein both the long and the short edges are provided with mechanical coupling parts 6-7-8-9 which allow the panels from the set to be coupled together; wherein a first long edge 2 is provided with a male coupling part 6 and a second long edge 3 is provided with a female coupling part 7; wherein a first short edge 4 is provided with a male coupling part 8 and a second short edge 5 is provided with a female coupling part 9; and wherein the first and the fourth type of panels have the same dimensions and wherein the coupling parts 6-7 on the long edges 2-3 of the first and the fourth type of panels are provided in mirror image.

In FIGS. 1,6 to 8 and 10 different embodiments of sets of floor panels are shown. Only in the first embodiment as shown in FIG. 1, the set of floor panels comprises the first, the second, the third and the fourth type of panels. In the other embodiments 6 to 8 and 10, at least one of the second, third or fourth type of panels is missing. However, since the embodiments shown in FIGS. 6 to 8 and 10 are only a part of the pattern of the floor covering, also said not shown types of panels could be present. The FIGS. 1 and 6 to 8 and 10 show possible laying patterns, of course other laying patters are not excluded. The main advantage of the invention is that lots of laying patterns are possible.

Figure 8:
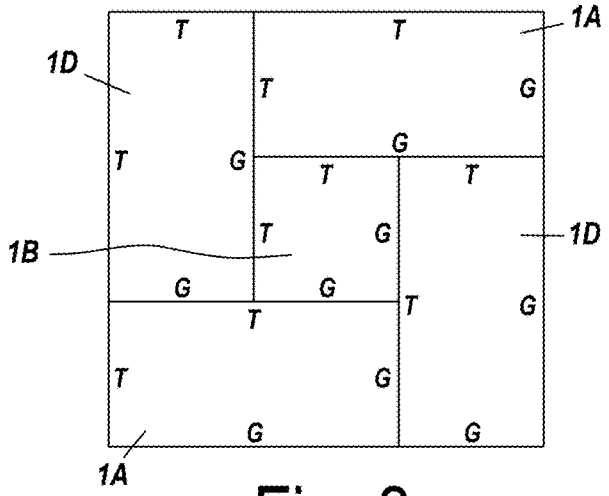
FIG. 8 shows a top view of a covering comprising a fourth embodiment of a set of panels according to the first aspect of the invention, comprising said first, said second and said fourth type of panels, wherein the covering has a certain pattern.
Figure 10:
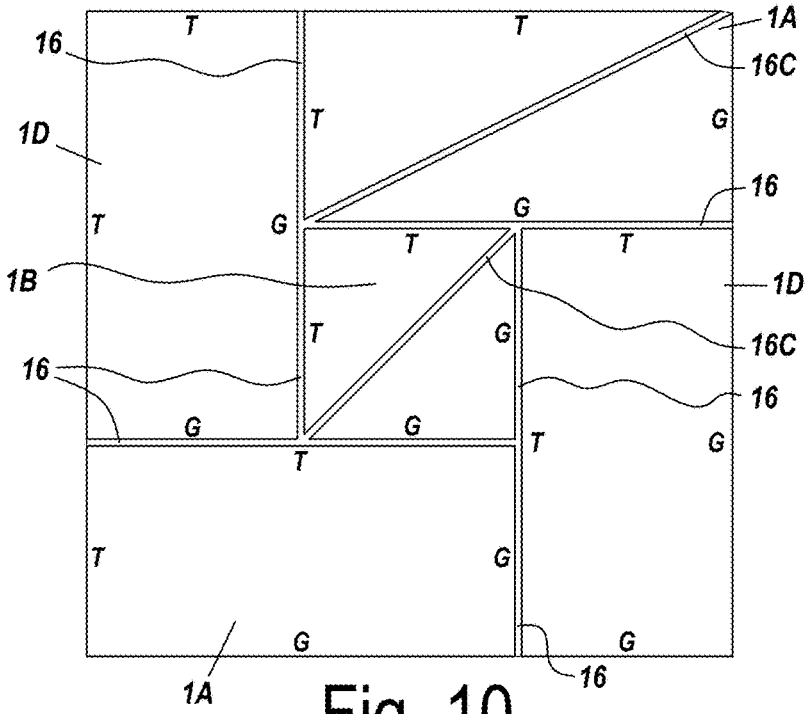
FIG. 10 shows a top view of a covering comprising a fifth embodiment of a set of panels according to the first aspect of the invention, comprising said first, said second and said fourth type of panels, wherein the covering has a certain pattern and comprises two panels of the type as shown in FIG. 9 and three panels of the type as shown in FIG. 5.

As can be seen in FIGS. 1 and 8 and 10, if both the first and the fourth type of panels are present, said first type of panels 1A extend according to a first direction and said fourth type of panels 1D extend according to a second direction, wherein the second direction is perpendicular to the first direction.

Figure 4:
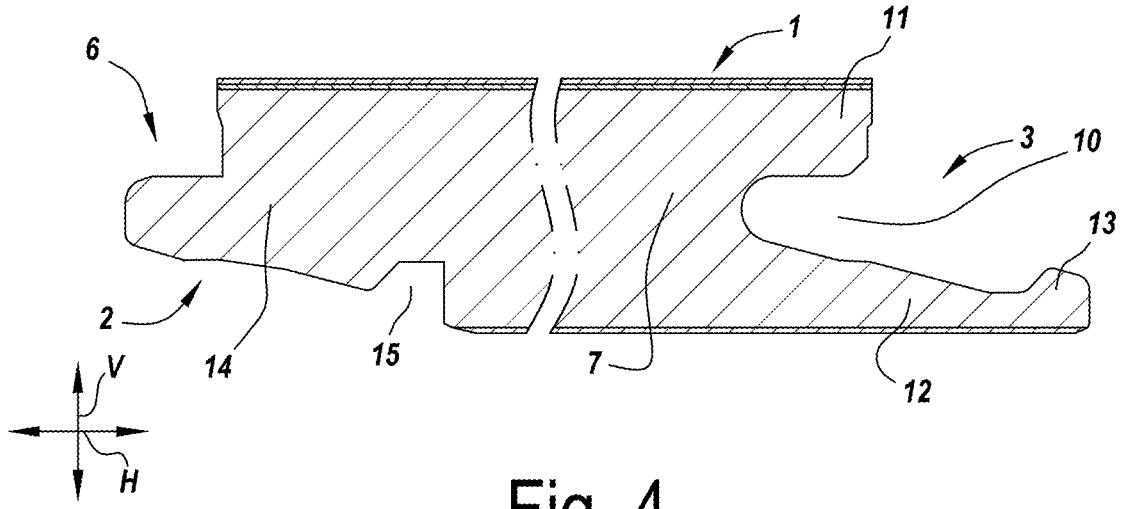
FIG. 4 shows a possible cross section of the first, second, third or fourth type of floor panel wherein the coupling parts at the height of the long edges/first opposite edges are visible.
Figure 5:
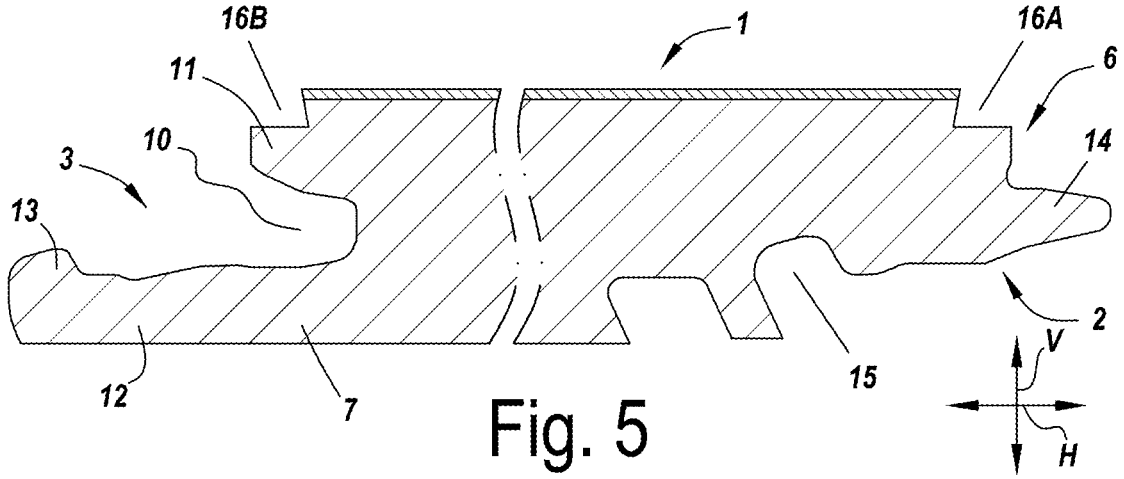
FIG. 5 shows another possible cross section of the first, second, third or fourth type of floor panel wherein the coupling parts at the height of the long edges/first opposite edges are visible.
Figure 6:
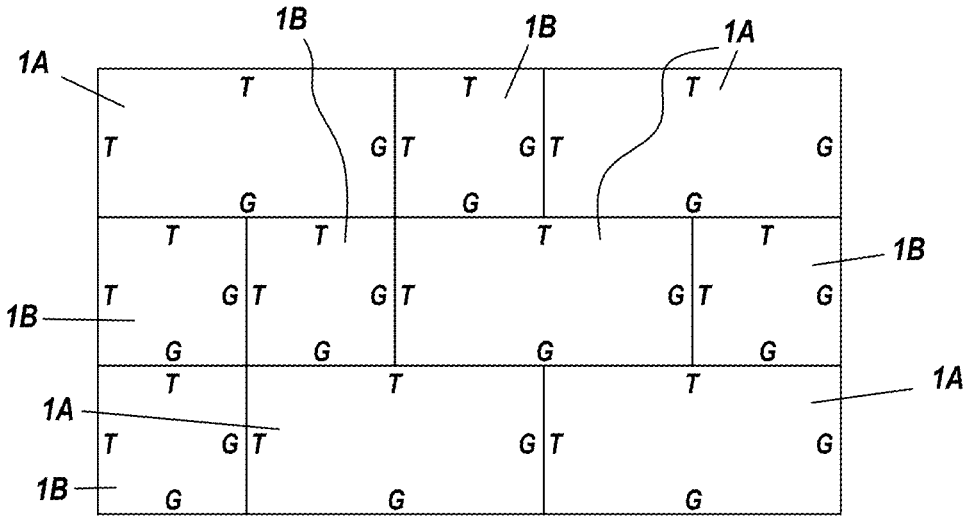
FIG. 6 shows a top view of a covering comprising a second embodiment of a set of panels according to the first aspect of the invention, comprising said first and said second type of panels, wherein the covering has a certain pattern.
Figure 7:
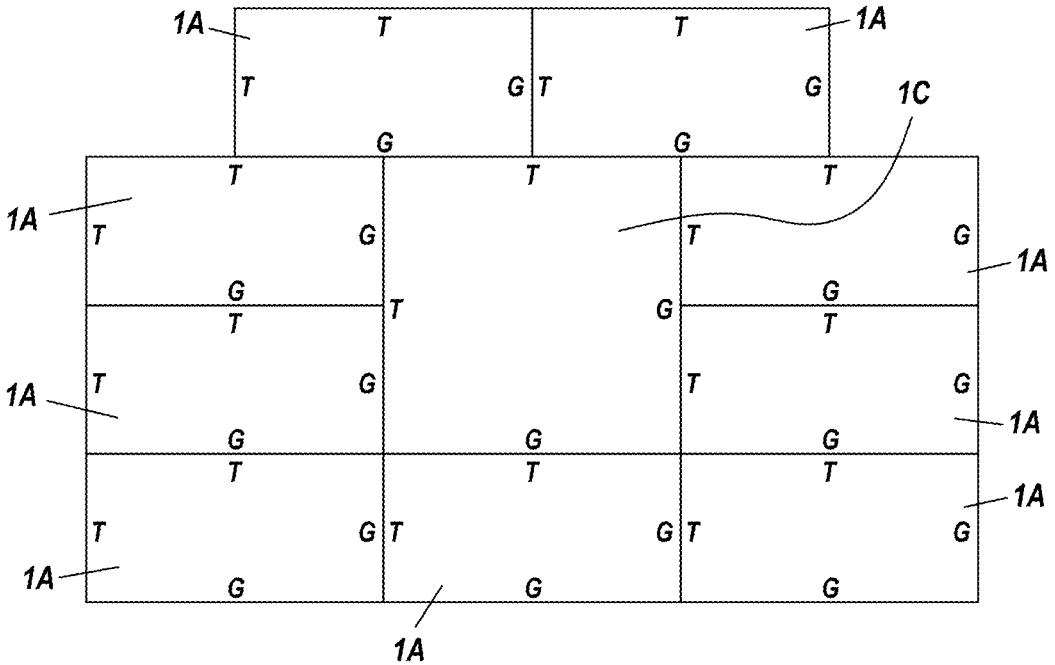
FIG. 7 shows a top view of a covering comprising a third embodiment of a set of panels according to the first aspect the invention, comprising said first and said third type of panels, wherein the covering has a certain pattern.

There is all sort of possibilities for the coupling parts 6-7-8-9. Preferably the coupling parts 6-7-8-9 comprise interlocking parts which, in a mutually coupled position of panels, bring about an interlocking in a horizontal direction H and an interlocking in a vertical direction V. In FIGS. 4 and 5 possible options of the long edges 2-3 of the first and fourth type of panels, and possible options for the first pair of edges 2-3 of the second and third type of panels are shown. Also the short edges 4-5 of the first and fourth type of panels and/or the second opposite edges 4-5 of the second and third type of panels, can be like this. If the latter is the case, the coupling parts 6-7-8-9 then all allow the panels from the set to be coupled together by means of a rotating movement (W) and/or a horizontal shifting movement, preferably a horizontal shifting movement with snap-effect. This possibility is shown in FIGS. 1 and 6 to 8 and 10, and the position of the male part is indicated as T, which stand for tongue (since the male part can have a tongue, see further) and the position of the female part is indicated as G, which stand for groove (since the female part can comprise a groove, see further). Another possibility is that the coupling parts 8-9 of the short edges 4-5 and/or second opposite edges 4-5 allow coupling of the fold-down type. Of course other embodiments for the coupling parts are possible.

As can be seen in FIGS. 4 and 5, the female coupling part 7 of the long edge 3 comprises a lateral groove 10 which is delimited by an upper lip 11 and a bottom lip 12, the bottom lip 12 extends distally beyond the upper lip 11 and is provided with an upwardly pointing interlocking part 13; and the male coupling part 6 of the long edge 2 is provided with a tongue 14 which, in the coupled position, can cooperate with the abovementioned lateral groove 10 in order to bring about a vertical interlocking and is provided with a downward directed interlocking groove 15 which, in the coupled position, can cooperate with the abovementioned upwardly pointing interlocking part 13. As can be seen in FIG. 5, recesses 16A, 16B are present on both long edges 2, 3 which are provided to form a joint/seam which can be grouted. Preferably the short edges 4, 5 are also provided with similar recesses. With the aid of such a type of panel, ceramic tiles can be very well mimicked, this because said formed joints/seams are grouted when the panels are installed, as such resembling grouted ceramic tiles. FIG. 10 show an installation pattern comprising three such types of panels and further two panels of the type as shown in FIG. 9.

Figure 9:
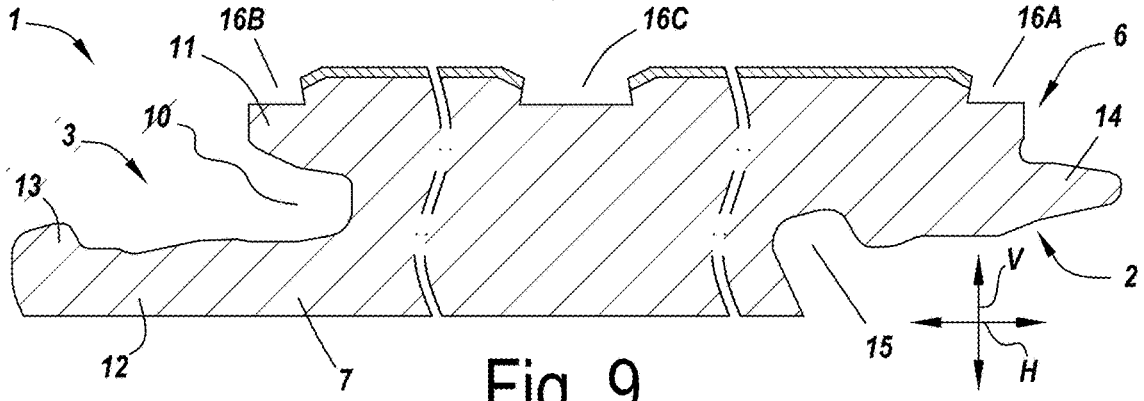
FIG. 9 shows another possible cross section of the first, second, third or fourth type of floor panel wherein the coupling parts at the height of the long edges/first opposite edges are visible.

As can be seen in FIG. 9 the female coupling part 7 of the long edge 3 comprises a lateral groove 10 which is delimited by an upper lip 11 and a bottom lip 12, the bottom lip 12 extends distally beyond the upper lip 11 and is provided with an upwardly pointing interlocking part 13; and the male coupling part 6 of the long edge 2 is provided with a tongue 14 which, in the coupled position, can cooperate with the abovementioned lateral groove 10 in order to bring about a vertical interlocking and is provided with a downward directed interlocking groove 15 which, in the coupled position, can cooperate with the abovementioned upwardly pointing interlocking part 13. As can be seen in FIG. 9, recesses 16A, 16B are present at both edges which are provided to form a joint which can be grouted. Further the panel comprises a central groove/recess 16*c*, corresponding to said recesses 16A, 16C. This groove 16C can run parallel with the two said long edges 2, 3 and is then preferably located centrally between said long edges 2,3. Said groove/recess 16C can also run diagonally as can be seen in FIG. 10, which shows two panels 1 of the type as shown in FIG. 9, namely a square panel and an elongate rectangular panel.

Figure 2:
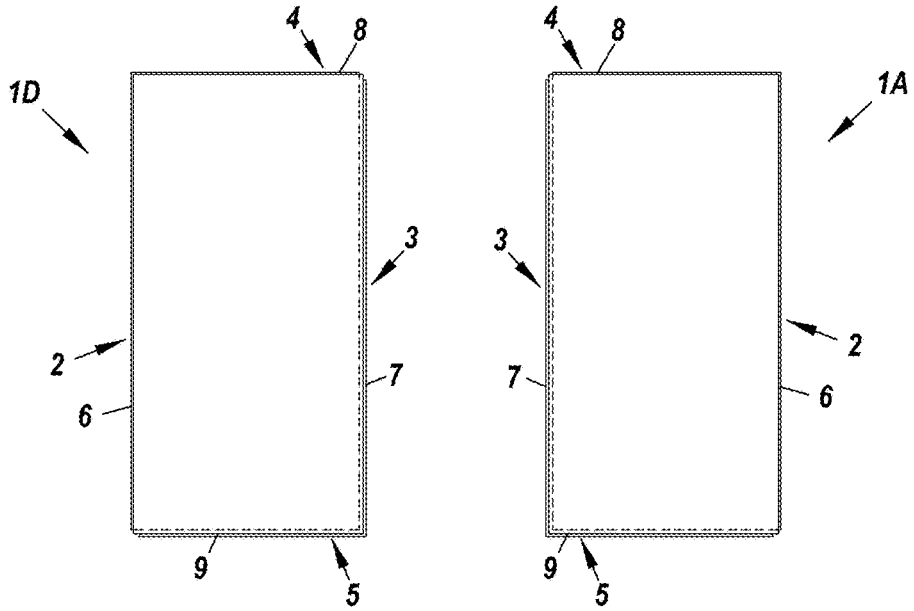
FIG. 2 shows on the left a top view of the fourth type of panel and on the right a top view of the first type of floor panel.

In FIG. 2, it is clearly shown that the coupling parts of the first and the fourth type of panels are mirrored with respect to each other along the longitudinal axis of the panels.

Figure 3:
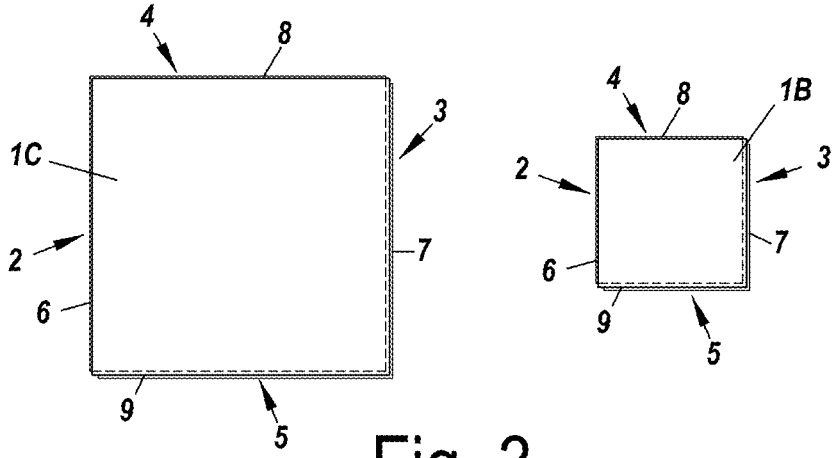
FIG. 3 shows on the left a top view of the third type of panel and on the right a top view of the second type of floor panel.

In FIG. 3, it is clearly shown that the dimensions of the edges of the second type of panels 1B match the dimensions of the short edges 4-5 of the first and the fourth type of panels, and that the dimensions of the edges of the third type of panels 1C match the dimensions of the long edges 2-3 of the first and the fourth type of panels, such that the upper surface of the third type of panels 1C is four times larger than the upper surface of the second type of floor panels 1B.

In the embodiment as shown in FIG. 10, the set of floor panels comprises the first, the second and the fourth type of panels. The panels are at least of the type comprising recesses 16A, 16B, as can be seen in FIG. 5, on both long edges 2, 3 and on both the short edges 4, 5 wherein recesses 16A, 16B of two coupled panels form a joint 16 which can be grouted. In FIG. 10 the joint 16 has not been grouted yet. Further, as can be seen in FIG. 10, two panels 1 are of the type as shown in FIG. 9 with a groove/recess 16C which has the same width dimension, being the dimension in the plane of the panel 1, as the joints 16. With the aid of such a type of panels 1, ceramic tiles can be very well mimicked, this because said joints 16 and recesses 16C are grouted after laying said panels 1, as such resembling grouted ceramic tiles.

Figure 11:
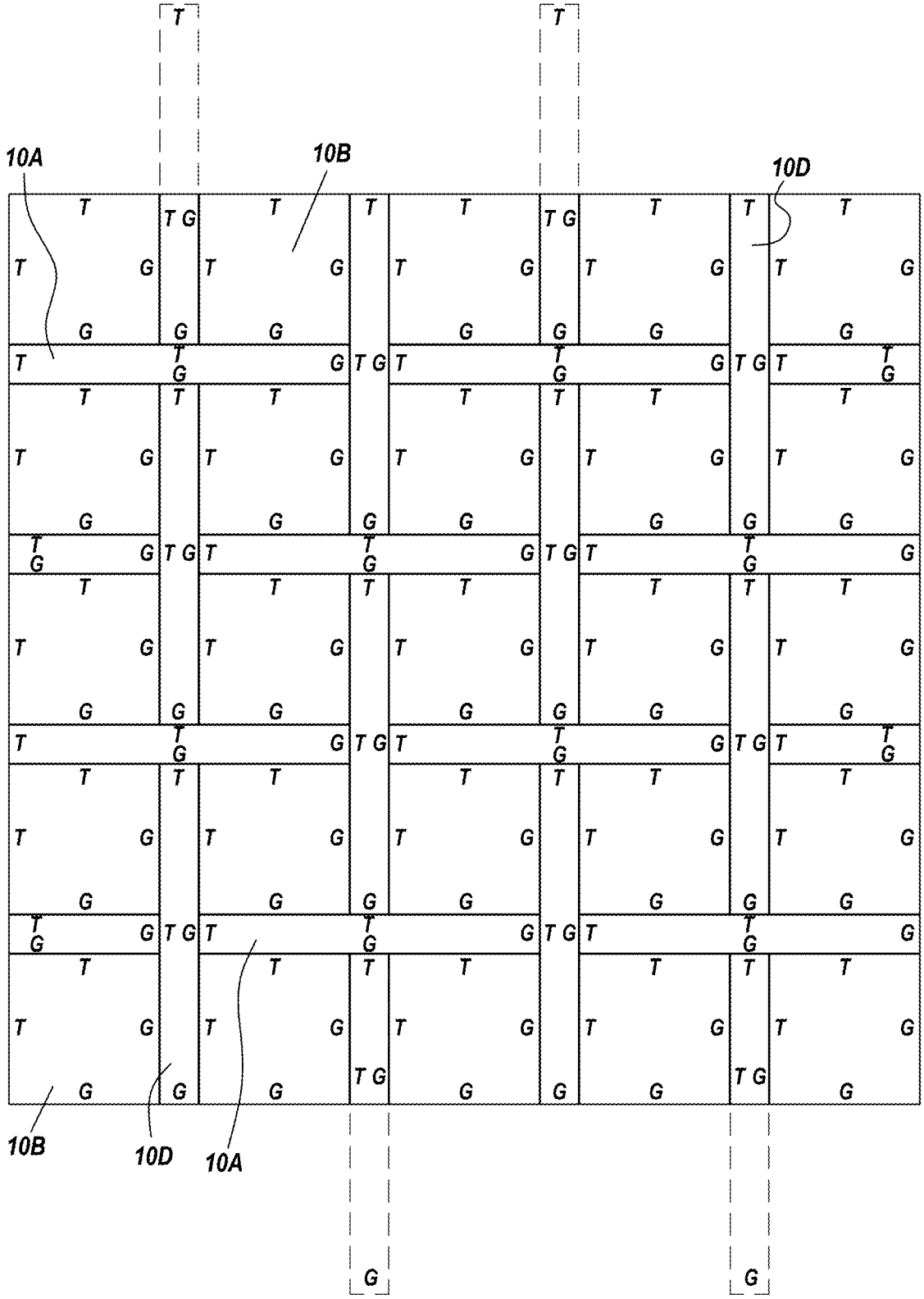
FIG. 11 shows a top view of covering comprising an embodiment of a set of panels according to the second aspect of the invention.

An embodiment of the second aspect of the invention is shown in FIG. 11. The invention according to the second aspect relates to a set of floor panels comprising—at least a first type of panels being elongate and rectangular panels 10A comprising a pair of long edges and a pair of short edges; wherein both the long and the short edges are provided with mechanical coupling parts which allow the panels from the set to be coupled together; wherein a first long edge is provided with a male coupling part and a second long edge is provided with a female coupling part; wherein a first short edge is provided with a male coupling part and a second short edge is provided with a female coupling part;

a second type of panels being square panels 10B comprising a first pair of opposite edges and a second pair of opposite edges; wherein said edges are provided with mechanical coupling parts which allow the panels from the set to be coupled together; wherein a first edge of the first pair of opposite edges is provided with a male coupling part and a second edge of the first pair of opposite edges is provided with a female coupling part; wherein a first edge of the second pair of opposite edges is provided with a male coupling part and a second edge of the second pair of opposite edges is provided with a female coupling part; wherein the dimensions of the first pair and the second pair of opposite edges are approximately half the dimensions of the long edges of the first type of panels 10*A minus* half the dimensions of the short edges of said first type of panels 10A;

a third type of panels being elongate and rectangular panels 10D comprising a pair of long edges and a pair of short edges; wherein both the long and the short edges are provided with mechanical coupling parts which allow the panels from the set to be coupled together; wherein a first long edge is provided with a male coupling part and a second long edge is provided with a female coupling part; wherein a first short edge is provided with a male coupling part and a second short edge is provided with a female coupling part; and wherein the first and the third type of panels have the same dimensions and wherein the coupling parts on the long edges of the first and the third type of panels are provided in mirror image.

The coupling parts of the panels of the second aspect of the invention can be as indicated in the first aspect of the invention and/or as indicated in the description and claims. There are thus all sort of possibilities for the coupling parts. Preferably the coupling parts comprise interlocking parts which, in a mutually coupled position of panels, bring about an interlocking in a horizontal direction and an interlocking in a vertical direction. For example the coupling parts allow the panels from the set to be coupled together by means of a rotating movement and/or a horizontal shifting movement, preferably a horizontal shifting movement with snap-effect. The male part can be indicated as T, which stand for tongue (since the male part can have a tongue) and the position of the female part can be indicated as G, which stand for groove (since the female part can comprise a groove).

FIG. 11 shows a basketweave pattern. On the edges of this pattern only parts of the first or third type of panels are needed, such that parts will need to be removed. For the edges at the top and at the bottom of the figure, the removed parts are indicated with dashed lines, where at the left and the right side of the figure the removed parts are not indicated with dashed lines. Of course, said removed parts can be used at other locations of the pattern where there is no need for full panels.

In FIG. 11, no recesses as can be seen in FIGS. 5 and/or 9, are shown, however the panels shown in FIG. 11 can have such recesses which then form joints which can be grouted.

The present invention is by no means limited to the above-described embodiments, but such methods and sets of floor panels may be produced according to different variants without departing from the scope of the present invention.

The invention claimed is:

1. A set of panels, comprising: a first type of panels being elongate and rectangular panels comprising a pair of long edges and a pair of short edges; wherein both the long and the short edges are provided with mechanical coupling parts allowing the panels from the set to be coupled together by means of a rotating movement and/or a horizontal shifting movement; wherein a first long edge is provided with a male coupling part and a second long edge is provided with a female coupling part; wherein a first short edge is provided with a male coupling part and a second short edge is provided with a female coupling part; and further comprising a second type of panels being square panels comprising a first pair of opposite edges and a second pair of opposite edges; wherein said edges are provided with mechanical coupling parts allowing the panels from the set to be coupled together by means of a rotating movement and/or a horizontal shifting movement; wherein a first edge of the first pair of opposite edges is provided with a male coupling part and a second edge of the first pair of opposite edges is provided with a female coupling part; wherein a first edge of the second pair of opposite edges is provided with a male coupling part and a second edge of the second pair of opposite edges is provided with a female coupling part; wherein the dimensions of the first pair and the second pair of opposite edges match the dimensions of the short edges of said first type of panels; and further comprising a third type of panels being square panels comprising a first pair of opposite edges and a second pair of opposite edges; wherein said edges are provided with mechanical coupling parts allowing the panels from the set to be coupled together by means of a rotating movement and/or a horizontal shifting movement; wherein a first edge of the first pair of opposite edges is provided with a male coupling part and a second edge of the first pair of opposite edges is provided with a female coupling part; wherein a first edge of the second pair of opposite edges is provided with a male coupling part and a second edge of the second pair of opposite edges is provided with a female coupling part; wherein the dimensions of the first pair and the second pair of opposite edges match the dimensions of the long edges of said first type of panels.

2. The set of panels according to claim 1, wherein the set of panels comprises a fourth type of panels being elongate and rectangular panels comprising a pair of long edges and a pair of short edges; wherein both the long and the short edges are provided with mechanical coupling parts allowing the panels from the set to be coupled together; wherein a first long edge is provided with a male coupling part and a second long edge is provided with a female coupling part;

wherein a first short edge is provided with a male coupling part and a second short edge is provided with a female coupling part; and wherein the first and the fourth type of panels have the same dimensions and wherein the coupling parts on the long edges of the first and the fourth type of panels are provided in mirror image.

3. The set of panels according to claim 2, wherein the panels of the first type of panels are provided to extend according to a first length direction and the panels of the fourth type of panels are provided to extend according to a second length direction, wherein the second length direction is perpendicular to the first length direction.

4. The set of panels according to claim 1, wherein a said male coupling part of one said panel can be coupled to each female coupling part of another said panel and wherein a said female coupling part of one said panel can also be coupled to each male coupling part of another said panel.

5. The set of panels according to claim 1, wherein the mechanical coupling parts allow the panels from the set to be coupled together by means of a downward motion.

6. The set of panels according to claim 1, wherein, for at least the first type of panels, the coupling parts of the long edges show the following characteristics:

the coupling parts comprise a horizontally active locking system, which, in a coupled condition of two of such floor panels, effects a locking in a plane of the floor panels and perpendicular to the long edges;

the coupling parts also comprise a vertically active locking system, which, in a coupled condition of two of such floor panels, effects a locking transverse to the plane of the floor panels; the coupling parts are configured such that two of such panels can be coupled to each other at the edges by means of a turning movement; wherein the coupling parts of the short edges show the following characteristics: the coupling parts comprise a horizontally active locking system, which, in a coupled condition of two of such floor panels, effects a locking in the plane of the floor panels and perpendicular to the short edges;

the coupling parts also comprise a vertically active locking system, which, in a coupled condition of two of such floor panels, effects a locking transverse to the plane of the floor panels; the coupling parts substantially are realized from a material of the floor panel or the coupling parts comprise an additional insert; the coupling parts comprise at least an upward-directed lower hook-shaped part situated on one of said two short edges, as well as a downward-directed upper hook-shaped part situated on the other of said two short edges, wherein the lower hook-shaped part consists of a lip with an upward-directed locking element, which, located proximally thereof, defines a female part as a recess, whereas the upper hook-shaped part consists of a lip with a downward-directed locking element forming a male part; the coupling parts are configured such that two of such floor panels can be coupled to each other at the short edges by means of a downward movement of one floor panel in respect to another panel.

7. The set of panels according to claim 1, wherein for at least the first type of panels, the male coupling part on the long edge can be fitted into the female coupling part on the long edge of another panel of the set by means of a rotating movement; wherein the male coupling part on the long edge can also be fitted into the female coupling part on the short edge of another panel from the set by means of a rotating movement; and wherein the male coupling part on the short edge can be fitted into the female coupling part on the long edge in one and the same rotating movement used to fit the male coupling part on the long edge into the female coupling part on the long or short edge.

8. The set of panels according to claim 1, wherein the coupling parts comprise interlocking parts that, in a mutually coupled position of panels, bring about an interlocking in a horizontal direction and an interlocking in a vertical direction.

9. A method for installing a set of panels, wherein a set of panels according to claim 1 is used, and in that a pattern is produced.

10. A set of panels, comprising a first type of panels being elongate and rectangular panels comprising a pair of long edges and a pair of short edges; wherein both the long and the short edges are provided with mechanical coupling parts allowing the panels from the set to be coupled together by means of a rotating movement and/or a horizontal shifting movement; wherein a first long edge is provided with a male coupling part and a second long edge is provided with a female coupling part; wherein a first short edge is provided with a male coupling part and a second short edge is provided with a female coupling part; wherein the coupling parts on both the long and the short edges substantially are realized from material of the panel itself; a second type of panels being square panels comprising a first pair of opposite edges and a second pair of opposite edges; wherein said edges are provided with mechanical coupling parts allowing the panels from the set to be coupled together by means of a rotating movement and/or a horizontal shifting movement; wherein a first edge of the first pair of opposite edges is provided with a male coupling part and a second edge of the first pair of opposite edges is provided with a female coupling part; wherein a first edge of the second pair of opposite edges is provided with a male coupling part and a second edge of the second pair of opposite edges is provided with a female coupling part; wherein dimensions of the first pair and the second pair of opposite edges are approximately half the dimensions of the long edges of the first type of panels minus half the dimensions of the short edges of said first type of panels; wherein the coupling parts on both the first pair and the second pair of opposite edges substantially are realized from material of the panel itself; a third type of panels being elongate and rectangular panels comprising a pair of long edges and a pair of short edges; wherein both the long and the short edges are provided with mechanical coupling parts allowing the panels from the set to be coupled together by means of a rotating movement and/or a horizontal shifting movement; wherein a first long edge is provided with a male coupling part and a second long edge is provided with a female coupling part; wherein a first short edge is provided with a male coupling part and a second short edge is provided with a female coupling part; wherein the coupling parts on both the long and the short edges substantially are realized from material of the panel itself; and wherein the first and the third type of panels have the same dimensions and wherein the coupling parts on the long edges of the first and the third type of panels are provided in mirror image.

11. The set of panels according to claim 10, wherein the panels of the first type of panels are provided to extend according to a first length direction and the panels of the third type of panels are provided to extend according to a second length direction, wherein the second length direction is perpendicular to the first length direction.

12. The set of panels according to claim 10, wherein a said male coupling part of one said panel can be coupled to each female coupling part of another said panel and wherein a said female coupling part of one said panel can also be coupled to each male coupling part of another said panel.

13. The set of panels according to claim 10, wherein the mechanical coupling parts allow the panels from the set to be coupled together by means of a downward motion.

14. The set of panels according to claim 10, wherein, for at least the first and/or the third type of panels, the coupling parts of the long edges show the following characteristics:

the coupling parts comprise a horizontally active locking system, which, in a coupled condition of two of such floor panels, effects a locking in a plane of the floor panels and perpendicular to the long edges;

the coupling parts also comprise a vertically active locking system, which, in a coupled condition of two of such floor panels, effects a locking transverse to the plane of the floor panels;

the coupling parts are configured such that two of such panels can be coupled to each other at the long edges by means of a turning movement; wherein the coupling parts of the short edges show the following characteristics: the coupling parts comprise a horizontally active locking system, which, in a coupled condition of two of such floor panels, effects a locking in the plane of the floor panels and perpendicular to the short edges; the coupling parts also comprise a vertically active locking system, which, in a coupled condition of two of such floor panels, effects a locking transverse to the plane of the floor panels; the coupling parts comprise at least an upward-directed lower hook-shaped part situated on one of said two short edges, as well as a downward-directed upper hook-shaped part, situated on the other of said two short edges, wherein the lower hook-shaped part consists of a lip with an upward-directed locking element, which proximally thereof, defines a female part in the form of a recess, whereas the upper hook-shaped part consists of a lip with a downward-directed locking element forming a male part; the coupling parts are configured such that two of such floor panels can be coupled to each other at the short edges by means of a downward movement of one floor panel in respect to another panel.

15. The set of panels according to claim 10, wherein for at least the first and the third type of panels, the male coupling part on the long edge can be fitted into the female coupling part on the long edge of another panel of the set by means of a rotating movement; wherein the male coupling part on the long edge can also be fitted into the female coupling part on the short edge of another panel from the set by means of a rotating movement; and wherein the male coupling part on the short edge can be fitted into the female coupling part on the long edge in one and the same rotating movement that is used to fit the male coupling part on the long edge into the female coupling part on the long or short edge.

16. The set of panels according to claim 10, wherein the coupling parts comprise interlocking parts, which, in a mutually coupled position of panels, bring about an interlocking in a horizontal direction and an interlocking in a vertical direction.

17. A set of panels, comprising: a first type of panels being elongate and rectangular panels comprising a pair of long edges and a pair of short edges; wherein both the long and the short edges are provided with mechanical coupling parts allowing the panels from the set to be coupled together;

wherein a first long edge is provided with a male coupling part and a second long edge is provided with a female coupling part; wherein a first short edge is provided with a male coupling part and a second short edge is provided with a female coupling part; and further comprising a second type of panels being square panels comprising a first pair of opposite edges and a second pair of opposite edges;

wherein said edges are provided with mechanical coupling parts allowing the panels from the set to be coupled together; wherein a first edge of the first pair of opposite edges is provided with a male coupling part and a second edge of the first pair of opposite edges is provided with a female coupling part; wherein a first edge of the second pair of opposite edges is provided with a male coupling part and a second edge of the second pair of opposite edges is provided with a female coupling part; wherein dimensions of the first pair and the second pair of opposite edges match the dimensions of the short edges of said first type of panels; and further comprising a third type of panels being square panels comprising a first pair of opposite edges and a second pair of opposite edges; wherein said edges are provided with mechanical coupling parts allowing the panels from the set to be coupled together;

wherein a first edge of the first pair of opposite edges is provided with a male coupling part and a second edge of the first pair of opposite edges is provided with a female coupling part; wherein a first edge of the second pair of opposite edges is provided with a male coupling part and a second edge of the second pair of opposite edges is provided with a female coupling part; wherein the dimensions of the first pair and the second pair of opposite edges match the dimensions of the long edges of said first type of panels; wherein for at least the first type of panels, the male coupling part on the long edge can be fitted into the female coupling part on the long edge of another panel of the set by means of a rotating movement; wherein the male coupling part on the long edge can also be fitted into the female coupling part on the short edge of another panel from the set by means of a rotating movement; and wherein the male coupling part on the short edge can be fitted into the female coupling part on the long edge in one and the same rotating movement used to fit the male coupling part on the long edge into the female coupling part on the long or short edge.

18. The set of panels according to claim 17, wherein a said male coupling part of one said panel can be coupled to each female coupling part of another said panel and wherein a said female coupling part of one said panel can also be coupled to each male coupling part of another said panel.

19. The set of panels according to claim 17, wherein the mechanical coupling parts of the short edges of the first type of panels allow the panels from the set to be coupled together by means of a downward motion.

20. The set of panels according to claim 17, wherein the coupling parts of the short edges show the following characteristics: the coupling parts comprise a horizontally active locking system, which, in a coupled condition of two of such floor panels, effects a locking in a plane of the floor panels and perpendicular to the short edges; the coupling parts also comprise a verticallyactive locking system, which, in a coupled condition of two of such floor panels, effects a locking transverse to the plane of the floor panels; the coupling parts comprise at least an upward-directed lower hook-shaped part situated on one of said two short edges, as well as a downward-directed upper hook-shaped part situated on the other of said two short edges, wherein the lower hook-shaped part consists of a lip with an upward- directed locking element, which, located proximally thereof, defines a female part as a recess, whereas the upper hook-shaped part consists of a lip with a downward-directed locking element forming a male part.

* * * * *